US005975604A

United States Patent [19]

Wolin et al.

[11] Patent Number: 5,975,604

[45] Date of Patent: Nov. 2, 1999

[54] GRAPPLE WITH UNIVERSAL ATTACHMENT DEVICE

[76] Inventors: Robert H. Wolin; William E. Wolin, both of 11121 Previtali Rd., Jackson, Calif. 95642

[21] Appl. No.: 08/863,541

[22] Filed: May 27, 1997

[51] Int. Cl.[6] ..... B66C 3/16

[52] U.S. Cl. ..... 294/88; 294/86.4; 294/106; 414/739

[58] Field of Search ..... 294/68.23, 86.41, 294/88, 104–107; 414/722–724, 739, 740

[56] References Cited

U.S. PATENT DOCUMENTS

| | | | |
|---|---|---|---|
| 2,725,996 | 12/1955 | Britton . | |
| 2,914,203 | 11/1959 | Gafner . | |
| 3,034,820 | 5/1962 | Schwartz et al. | 294/88 |
| 3,152,706 | 10/1964 | Conrad | 294/88 X |
| 3,384,409 | 5/1968 | Guinot | 294/88 |
| 3,651,966 | 3/1972 | Willett . | |
| 3,877,743 | 4/1975 | Johnson | 294/88 |
| 4,017,114 | 4/1977 | LaBounty | 294/88 |
| 4,023,848 | 5/1977 | Bennett | 294/88 |
| 4,248,471 | 2/1981 | Labounty | 294/88 |
| 4,426,110 | 1/1984 | Mitchell et al. | 294/88 |
| 4,542,929 | 9/1985 | Possinger | 294/88 |
| 4,848,703 | 7/1989 | Coulson et al. | 294/88 X |
| 4,907,356 | 3/1990 | Labounty . | |
| 5,536,133 | 7/1996 | Velez et al. | 294/88 X |

*Primary Examiner*—Johnny D. Cherry
*Attorney, Agent, or Firm*—L. E. Carnahan

[57] ABSTRACT

An attachment device for releasably attaching a grapple to the end of a boom. The device includes a grapple body which mounts main and linkage pins which releasably couple with double pin mounting structures of different sizes and configurations. Hydraulic actuators within the housings on either side of the grapple are operated to open and close the jaws of the grapple under influence of an hydraulic control circuit. Tapered lock bushings are provided to releasably mount the main pins within openings in side walls of the housings. Adapter blocks are provided for mounting the ends of the linkage pins to the housings walls. A fastening arrangement for securing the adapter block enables the linkage pin to be mounted at different separation distances from the main pin to accommodate different types of pin mounting systems that may be encountered on vehicles at different job sites.

20 Claims, 8 Drawing Sheets

GRAPPLE WITH UNIVERSAL ATTACHMENT DEVICE

BACKGROUND OF THE INVENTION

1. Field of the Invention

This invention relates in general to grapples for use in grasping, raking, lifting or moving objects in logging operations, construction, demolition and other industrial fields. In particular, the invention relates to grapples carried on booms which are mounted on equipment such as off-road vehicles and the like.

2. Description of the Related Art

Grapples carried on the booms of wheeled or endless track type tractors are commonly used in logging operations to hoist and move logs or trees. Grapples are also used in a wide variety of construction and demolition activities, such as for moving concrete dividers, rails, large rocks, stumps, trees, chunks of broken concrete or asphalt, debris and other material or objects.

A typical prior art grapple arrangement employs a main boom pivotally mounted on a vehicle, a dipper stick mounted on the end of the main boom and a grapple mounted on the end of the dipper stick. Hydraulic actuators pivot the main boom relative to the vehicle and also pivot the dipper stick relative to the main boom. The typical grapple has two jaws which are pivotally connected to the end of the boom. An hydraulic actuator carried on the dipper stick operates through a linkage to pivot one jaw of the grapple for grasping and releasing objects, such as disclosed in U.S. Pat. Nos. 4,248,471 and 4,907,356. However, the equipment operators of these prior art configurations have a limited degree of control of movement for the grapples. The typical control set-up comprises one lever for raising and lowering the main boom, another lever for controlling pitch of the dipper stick and another lever for controlling pitch of the grapple relative to the dipper stick. In the case where the boom is mounted to the vehicle or structure by a swivel, another lever controls movement of the boom about a vertical axis. After the grapple is holding the load, the operator can only control its pitch attitude by means of the controls for the main boom and dipper stick; there is no independent control for the pitch of the grapple relative to the dipper stick. It would be desirable to provide apparatus in which the grapple can be independently controlled like the wrist joint of the human arm and thereby provide greater versatility in grasping, lifting and moving, and raking ground surface for the clearing of objects.

The prior art also includes grapple configurations in which the grapple is carried through a vertical swivel on the end of a boom or dipper stick, and in which a pair of jaws below the swivel joint are pivoted to open and close by a pair of extensible actuators, such as in U.S. Pat. No. 3,877,743. Configurations of this type also have the drawback of the inability to independently control the pitch of the pair of jaws relative to the boom. In addition, the provision of a single hydraulic actuator for each jaw means that, to provide the requisite thrust forces on the jaws, relatively large moment arms must be provided from the pivot center of the jaws to the thrust line of the actuator. This results in a relatively large change in the length of the moment arm, and therefore a large change in the mechanical advantage, throughout the actuator stroke. It would be desirable to provide a grapple apparatus by which the actuators can apply the requisite thrust forces to the jaws or other tools without an unduly large change in mechanical advantage throughout the stroke.

Quick couple devices have been provided in the prior art for releasably coupling grapples, buckets and the like to the end of booms. These quick couple device employ hooks which are operated to engage sets of pins provided on the grapples or buckets. However, such a quick couple device employs an hydraulic actuator to engage or release a hook with one of the pins, and this entails the use of hydraulic lines into the pressurized fluid circuit as well as a separate control. Such an arrangement increases the complexity and cost of the configuration.

The need has therefore been recognized for a grapple apparatus which obviates the foregoing and other limitations and disadvantages of prior art grapple devices. Despite the various grapple devices in the prior art, there has heretofore not been provided a suitable and attractive solution to these problems.

OBJECTS AND SUMMARY OF THE INVENTION

It is a general object of the invention to provide a new and improved grapple device for attachment to the end of a boom for use in grasping or lifting or moving objects.

Another object is to provide a new and improved attachment device for releasably attaching a grapple to the end of a boom.

Another object is to provide a universal device for attaching a grapple to mounting pins carried by the boom in which the device can be adjusted for pins of varying size and of varying center-to-center distances.

The invention in summary provides grapple apparatus comprising pairs of hydraulic actuators which are carried within housings which are mounted to pivot when the actuators extend and retract to move tines or other tools carried on the housings toward and away from one another. One of the housings carries a set of main and linkage pins for releasably attaching the grapple to a mounting structure carried by the boom. Tapered lock bushings are provided on the ends of the main pin for providing a releasable fit into openings provided on the housings on one side of the grapple. Main pins of different diameters can be fitted into the housing openings for matching different size mounting structures that may be encountered on different booms. The linkage pin is mounted at its opposite end to the sockets of adapter blocks which are attached to the housings by fasteners which penetrate through holes provided in the adapter block and housing walls. The circle of fastener holes in the adapter block is offset from the center of the socket so that the separation distance between the main and linkage pins can be varied as required for accommodating different separation distances in mounting structures encountered on different booms.

The foregoing and additional objects and features of the invention will appear from the following description of the invention taken in conjunction with the accompanying drawings.

DESCRIPTION OF THE PREFERRED EMBODIMENTS

Figure 1:
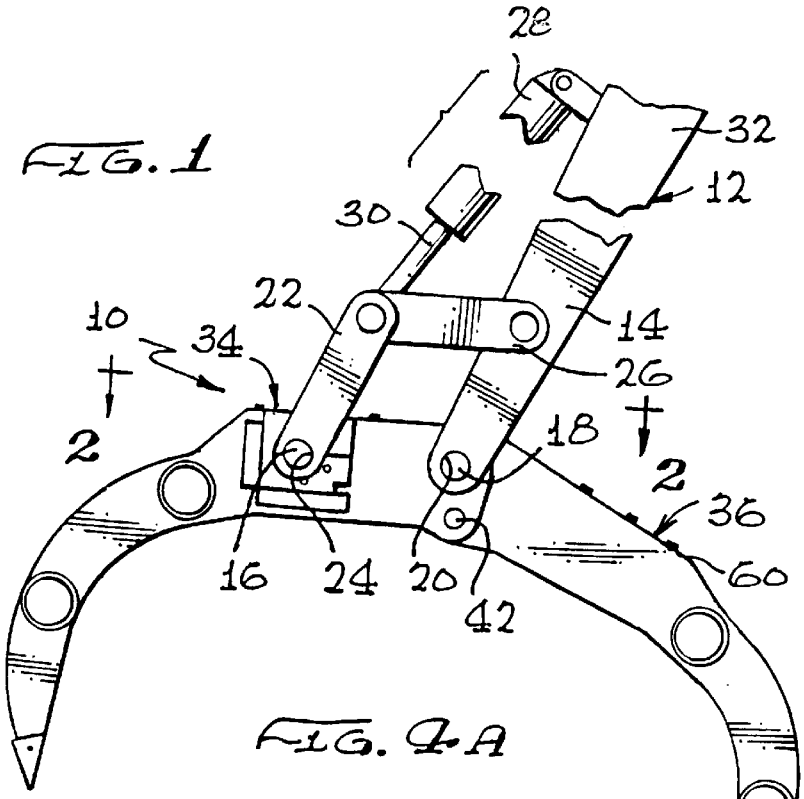
FIG. 1 is a side elevation view of grapple apparatus in accordance with one embodiment of the invention shown coupled to the end of a dipper stick which forms a part of a boom.

In the drawings FIG. 1 illustrates generally at 10 a grapple apparatus in accordance with one preferred embodiment of the invention. Apparatus 10 is adapted for releasable coupling on the end of a boom assembly 12 which is comprised of a dipper stick 14 and a main boom, not shown. The main boom is pivotally connected at its distal end to the upper end of the dipper stick. The boom assembly is mounted on a support structure, not shown, such as an excavator or backhoe type vehicle, which can be a wheeled or endless track type tractor.

Grapple apparatus 10 is adapted for attachment to a double pin mounting structure of the type that is commonly employed on excavator or backhoe type vehicles. In such a mounting structure the normal excavating bucket or backhoe would be removed with apparatus 10 then attached to the set of double pins 16 and 18 in the manner described below. In FIG. 1 the distal end of dipper stick has an opening 20 adapted for receiving one of the pins of the normal mounting structure, and the distal end of a pitch control link 22 is provided with an opening 24 for receiving the second pin of the normal mounting structure. A support link 26 is pivotally connected at one end to the proximal end of link 22, and at its other end to the dipper stick. An hydraulic actuator 28 is connected by its extensible rod 30 to the proximal end of link 22 and by its head end to the upper end 32 of the dipper stick.

A suitable control, not shown, in the operator's compartment of the vehicle is used for operating the actuator 28 to control the pitch of grapple apparatus 10 in forward and reverse tilting movements. While the illustrated embodiment shows a mounting structure comprising openings which receive the transverse pins 16 and 18 of the grapple apparatus in the manner explained below, the invention contemplates that the quick couple device 210 of the embodiment of FIG. 9 could alternatively be mounted on the distal ends of the dipper stick 214 and link 22.

Figure 6:
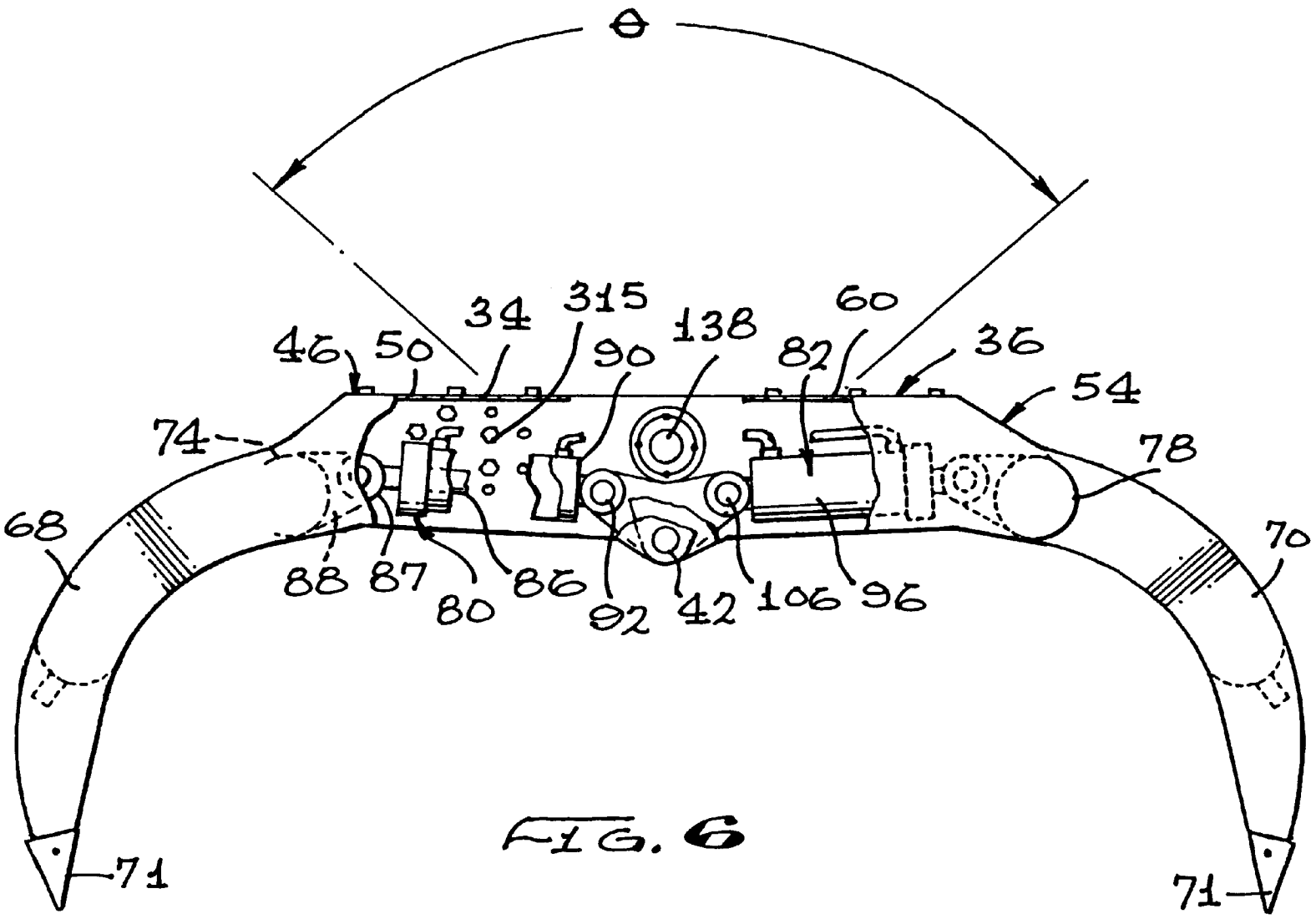
FIG. 6 is a partially cut away view of the grapple apparatus of FIG. 5 showing the jaws in their fully extended positions.
Figure 7:
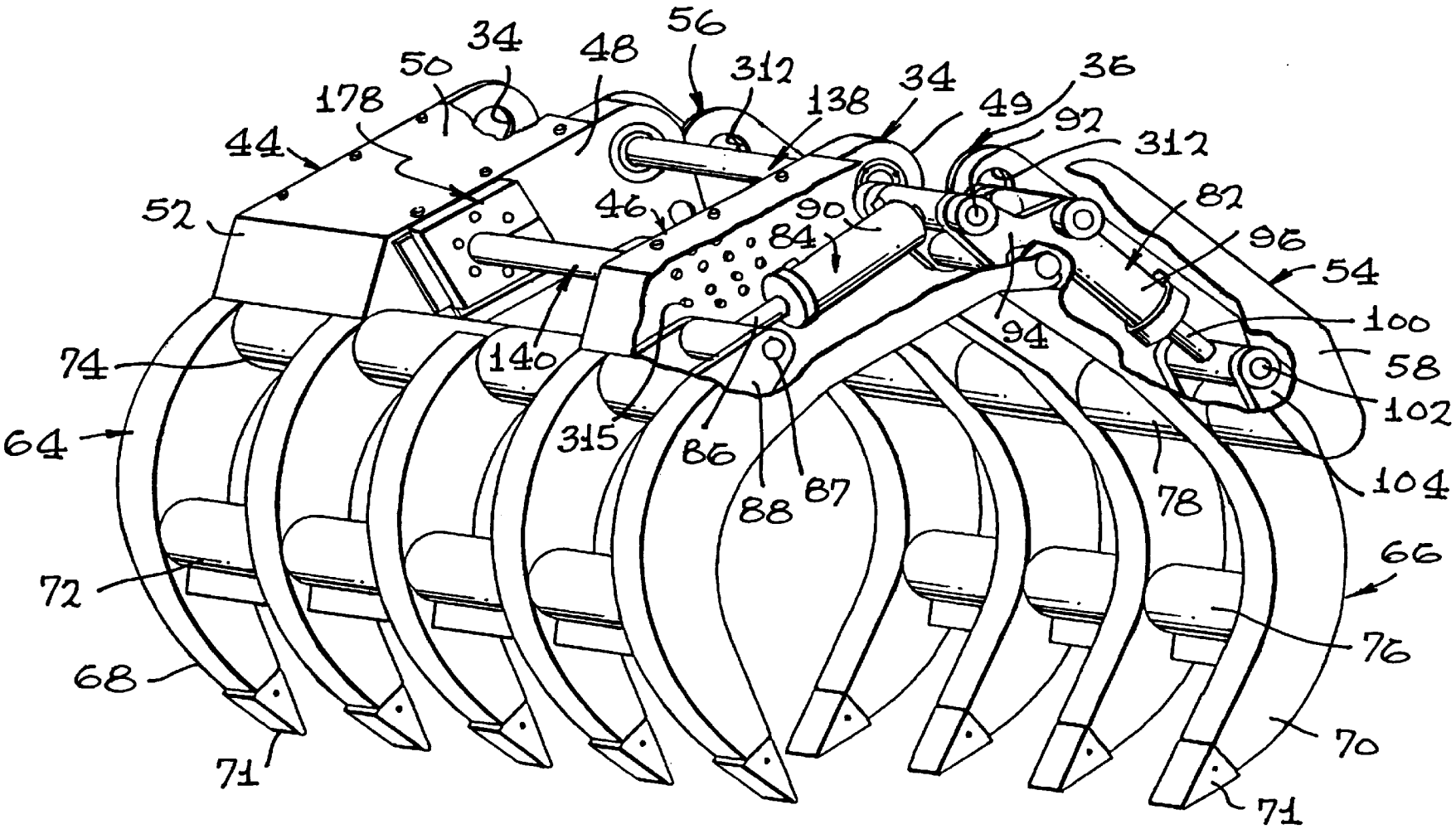
FIG. 7 is a fragmentary and partially broken-away perspective view, to an enlarged scale, of component parts of the grapple apparatus of FIG. 1.

Grapple apparatus 10 is comprised of a pair of grapple bodies or supports 34 and 36 which are mounted in side-by-side relationship at their proximal ends by means of a pivot pin 42 for pivotal movement about a transverse axis (FIG. 7). The first support 34 comprises a pair of housings 44, 46 which comprise respective side plates 48, 49 (FIG. 7), top plates 50 and end plates 52. The second support 36 similarly comprises a pair of housings 54, 56 comprising respective side walls 58 (FIG. 7), top plates 60 and end plates 62 (FIG. 6). The distal ends of the supports carry sets of tools 64 and 66, which are shown in FIG. 7 as comprising a plurality of tines 68, 70 curving toward each other in the manner of jaws and which have replaceable wear caps 71. As used herein, "tool" means tines, teeth, claws, bucket shells or other structures of the type used for grasping or lifting or moving objects, such as logs, concrete abutments, rails, rocks, tree stumps, earth and the like.

Figure 5:
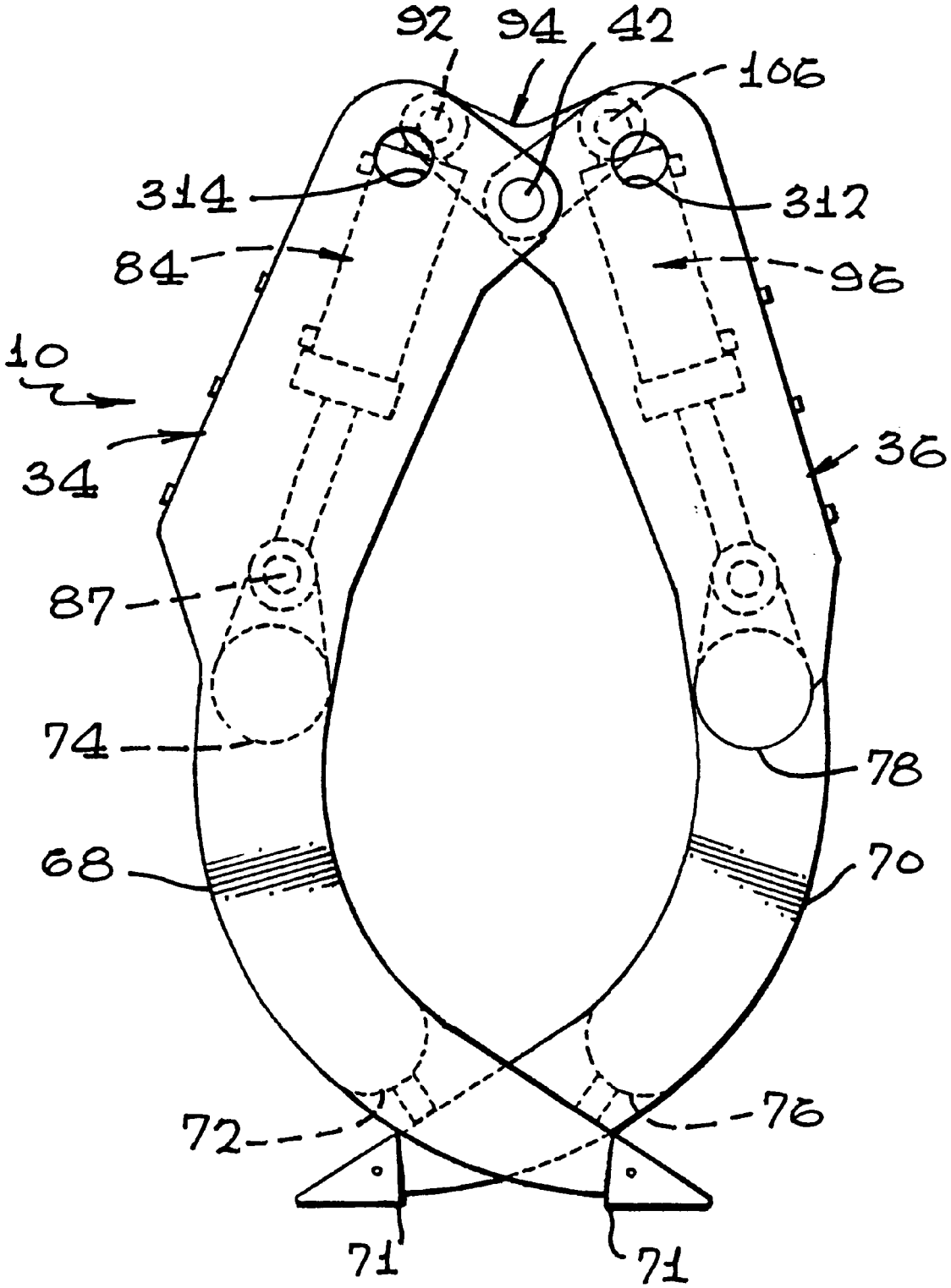
FIG. 5 is a side elevational view of the grapple apparatus of FIG. 1 showing the jaws in their fully retracted positions.

The set of five tines 68 carried by first support 34 is offset along the pivot axis from the opposing set of four tines 70 carried by the second support. This enables the tips of the opposing tines to overlap when the grapple is actuated to its fully closed position, as shown in FIG. 5. Sets of transversely extending pipes 72–78 are secured as by welding between adjacent tines to reinforce the tines and hold them in position. The group of five tines combines to form one jaw of the grapple, while the group of four tines combine to form another jaw (FIG. 7). The jaws are actuated between the fully closed position of FIG. 5 and the fully extended position of FIG. 6 by means of a pair of extensible hydraulic actuators, one of which is shown at 80, that are carried by first support 34. Another pair of extensible hydraulic actuators, one of which is shown at 82, is carried by second support 36.

Each hydraulic actuator is supported within a respective housing to protect the actuator and its associated hoses and couplings from damage. As best shown in FIGS. 6 and 7, actuator 80 is within housing 46 and comprises a cylinder 84 having a piston, not shown, on an extensible rod 86 which is pivotally mounted at pin 87 to a bracket 88 which in turn is secured as by welding to pipe 74 at the distal end of the housing. The head end 90 of cylinder 80 is pivotally mounted by pin 92 to a bell crank 94 which provides a force-resisting element for opposing actuator 82. Bell crank 94 is pivotally mounted about pin 42 which also provides the pivot axis for the jaws of the grapple.

Housing 54 of the second support encloses actuator 82 which comprises a cylinder 96 having a piston, not shown, and extensible rod 100 which is mounted by pivot pin 102 to a bracket 104 that is welded to tube 78 at the distal end of the housing. The head end of cylinder 96 is mounted by pivot pin 106 to a lever arm portion of the bell crank. This arm portion extends radially outwardly from pin at an included angle θ, which preferably is 100°, from the lever arm portion which carries pin 92 that mounts the opposing cylinder. This geometry enables each jaw to pivot through an angle of 70° so that the full angular range of travel between fully opened and fully closed positions of the two jaws is 140°.

Figure 8:
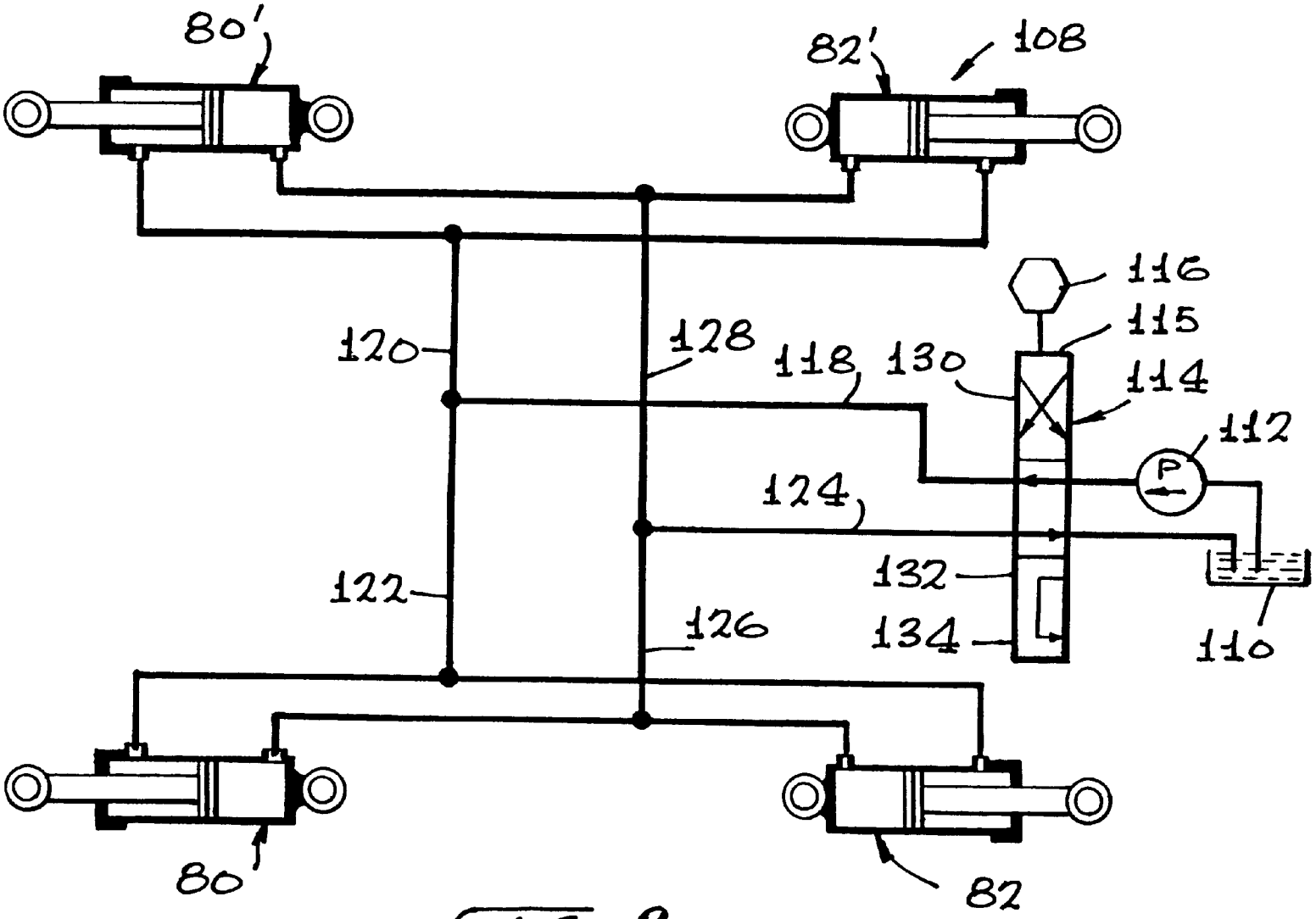
FIG. 8 is a schematic diagram of a control circuit for the hydraulic actuators which form components of the grapple of FIG. 1.

FIG. 8 shows hydraulic control system 108 which enables control of the grapple jaws by a single control lever in the operator's compartment independent of the controls for the boom dipper stick. Control system 108 includes a source of fluid pressure comprising a fluid reservoir 110 and hydraulic pump 112. Fluid pressurized by the pump is directed into flow control valve 114 having a spool 115 which is moved axially between three positions by a control 116. A first conduit 118 leading from the control valve is coupled with conduits 120, 122 which are connected through parallel conduits into the rod ends of the four actuator cylinders. A second conduit 124 leading from the control valve is directed into conduits 126, 128 which are connected through parallel conduits to the head ends of the actuators. The control 116 can be operated by a push button on a control stick, not shown, in the operator's compartment used to control actuator 28 on the dipper stick. To close the grapple jaws, control 116 is operated to move spool sector 130 into alignment with conduits 118 and 124 so that fluid is directed into the cylinder head ends for extending the rods. Return fluid from the rod ends is directed back to the reservoir through conduits 120 and 122 into conduit 118. When control 116 is actuated to bring spool sector 132 into alignment with conduits 118 and 124, pressurized fluid is directed into the rod ends for retracting the actuators while return fluid from the head ends is directed back to the reservoir by conduits 126 and 128 through conduit 124. The neutral position is when the control moves spool sector 134 into alignment with the conduits so that pressurized fluid is recycled back to the reservoir.

FIGS. 1–4 and 7 illustrate main pin 138 and linkage pin 140 which are releasably mounted through openings 20 and 24 on the dipper stick and pitch control link, as well as details for mounting the main and linkage pins to the grapple apparatus. Main pin 138 is comprised of an elongate shank 142 which extends transversely between the inner walls 48, 49 of the housings on the first support. The opposite ends 144, 146 of the shank are each fitted with tapered lock bushings 148, 150.

Preferably, the lock bushings 148 and 150 are of the type known as a Dodge taper lock. Each bushing is split longitudinally on one side by a slot 152 and has an inner bore 154 commensurate with the outer diameter of the end of shank 142. The outer surface 156 of each bushing tapers down to a reduced diameter proximally of its end. A mounting structure comprising openings 158, 160 is formed in respective housing walls 48 and 49, and each opening is formed with a female taper which is commensurate with the bushing taper. A plurality of axially extending semicircular threaded grooves 162, 164, shown as three, are formed at equal spacing about and partially along the periphery of each bushing at their wide diameter ends. A plurality of axially extending semicircular threaded grooves 166, corresponding in number to the grooves of the bushing, are also formed about and partially along the inner periphery of housing openings 158 and 160. Each bushing is inserted into the corresponding openings so that the opposing grooves are aligned to form threaded blind holes, and screws 170, 172 are then turned into these holes. The screws are then turned down sufficient to advance the two bushings into the openings. The tapered geometry causes the sides of the bushing to wedge between the openings and pin shank, thereby tightly capturing the main pin between the openings. The pin can be easily removed by first backing out the screws 170, 172 and then withdrawing the bushings by means of a removal screw, not shown. The removal screw is turned into semicircular threaded grooves 174, 176 which are formed completely along one side of each bushing. A corresponding unthreaded semicircular groove 175 is formed on each opening 158 and 160. This enables replacement with a main pin of a different diameter suitable for use with a mounting system having openings of different diameters.

FIGS. 5 through 7 illustrate housings 54, 56 and the most outwardly portion of housings 44 and 46 which are fitted with openings 312 and 314 respectively, so located as to have their centers in straight alignment with main pin 138 when the grapple jaws are in their fully open position, as illustrated in FIG. 6. The shape of the bell crank 94 accommodates the removal of the main mounting pin 138 from support structure 34 through openings 312 and 314.

Figure 4A:
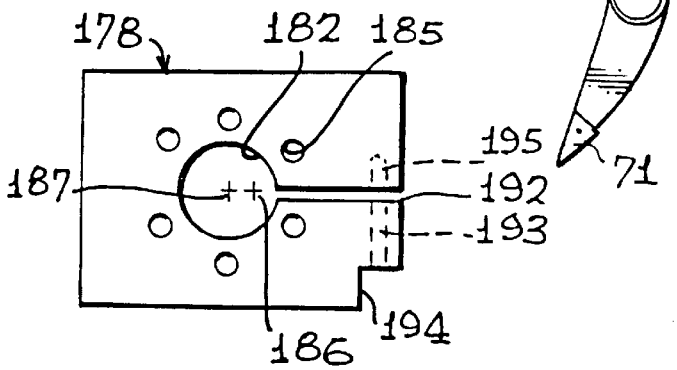
FIGS. 4A and 4B show details of a fragmentary side elevation view of one of the adapter plates and housing walls for the grapple shown in FIG. 3.
Figure 4B:
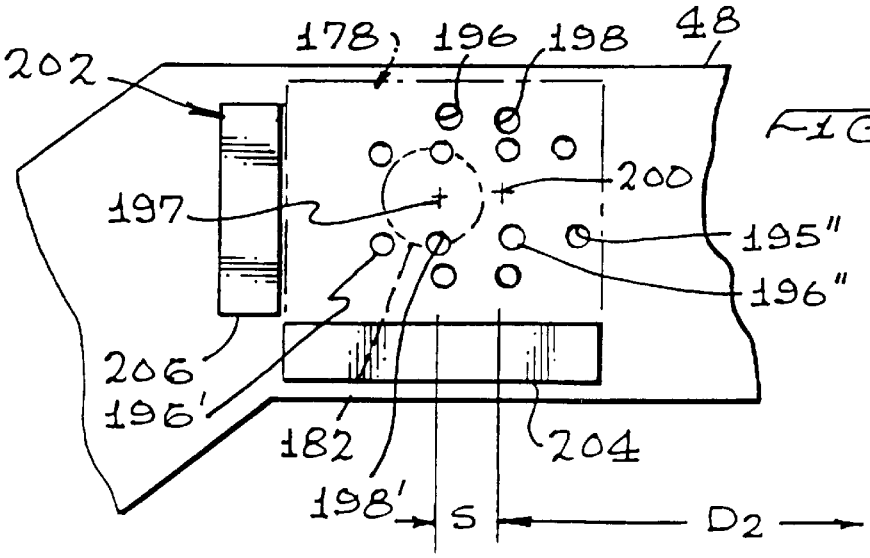
Figure 2:
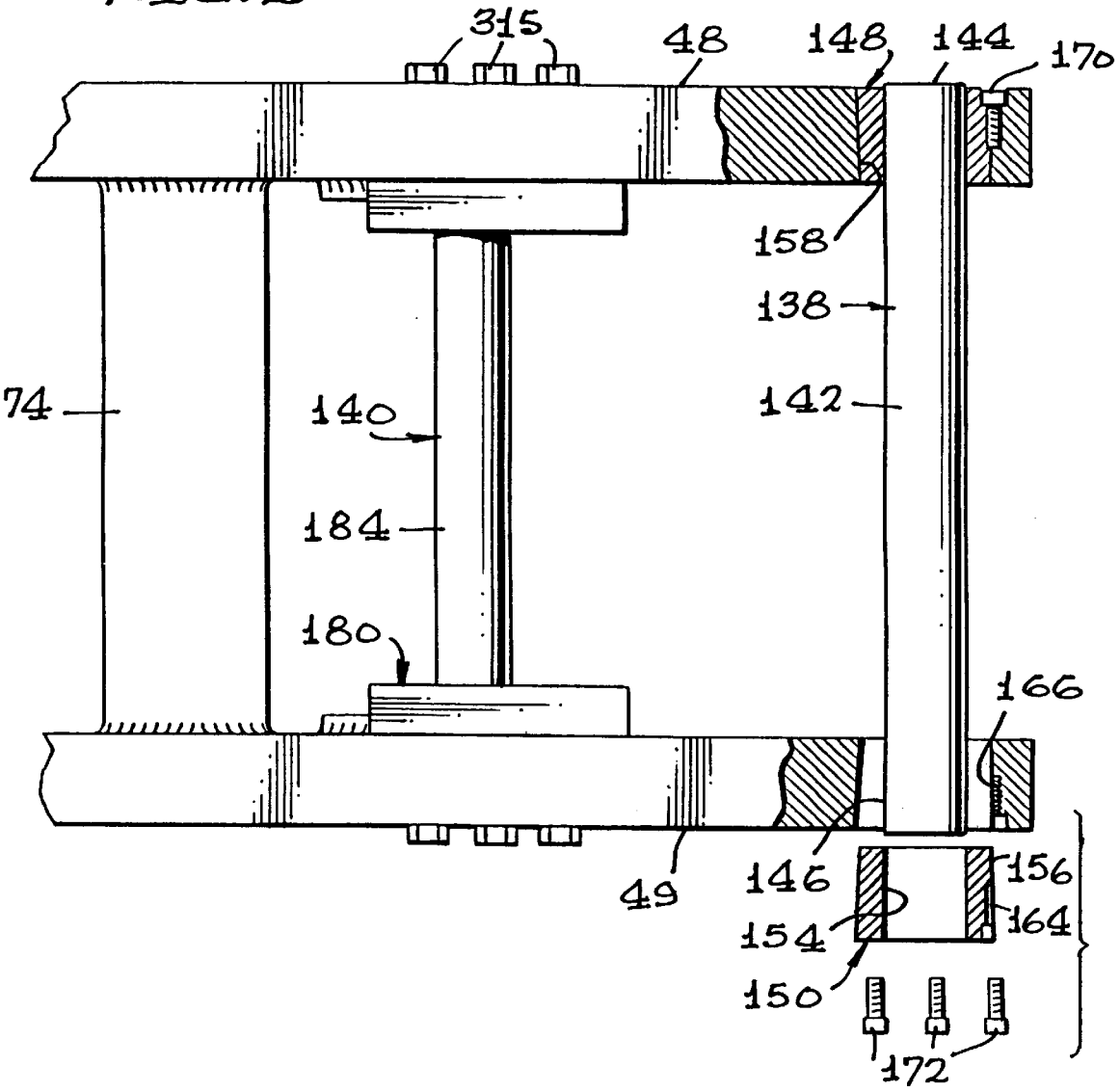
FIG. 2 is a partially broken away and partially exploded top plan view, to an enlarged scale, of the grapple apparatus taken along the line 2—2 of FIG. 1.
Figure 3:
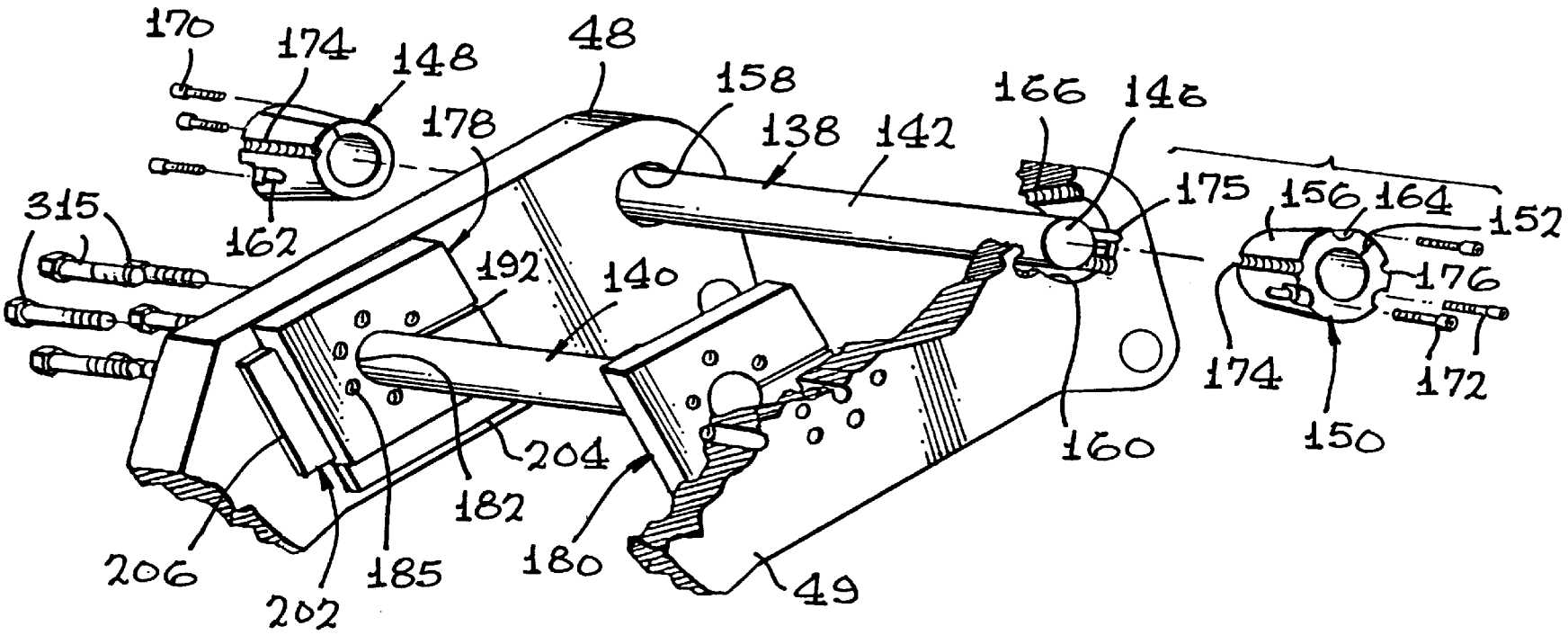
FIG. 3 is a partially broken away and partially exploded perspective view, to an enlarged scale, illustrating details of the grapple apparatus of FIG. 1.

FIGS. 2, 3, 4A and 4B show details of the system of the invention employing a pair of adapter blocks 178, 180 for releasably attaching the opposite ends of linkage pin 140 to the first support. Adapter block 178 is typical of the pair and is of rectangular shape formed with a socket 182 comprised of an opening sized commensurate with the outer diameter of linkage pin shank 184. A plurality of threaded holes 185 (FIG. 4A), shown as six, are formed through the adapter block in spaced-apart relationship about a hole cluster center 186. FIG. 4B shows block 178 in phantom view superimposed over the inner face of housing wall 48. The socket has a center 187 which is aligned with the longitudinal axis of the linkage pin when the pin end is fitted into the adapter block. Socket center 187 is positioned eccentric of the hole cluster center 186, as best shown in FIG. 4A. One side of the adapter block is cut to form a slot 192. An unthreaded hole 193 is drilled through one side of the block in a direction laterally across the slot, and a threaded blind hole 195 is drilled in the opposite side. A machine screw, not shown, is turned in through holes 193 and 195 to draw the adapter block together on opposite sides of the slot and tighten it on the end of the linkage pin. A cut-out 194 is provided in the block edge for seating the screw head.

The holes 185 in the adapter block are threaded for receiving the threaded ends of fastener bolts 315. A first cluster of six unthreaded holes 196–196" is drilled through housing wall 48 at spaced-apart positions, matching the adapter block holes, about a hole circle having a center at 197. A second cluster of six unthreaded holes 198–198" is drilled through the housing wall at spaced-apart positions which also match the adapter block holes, but the holes of this cluster are positioned about a circle having a center at 200 which is spaced a predetermined spacing S (FIG. 4B) from hole center 197. Hole center 197 locates the centerline of the linkage pin at a first separation distance $D_1$ from the centerline of the main pin, while the center 200 locates the linkage pin at a second separation distance $D_2$ from the main pin. This defines a range of separation distances at which the main and linkage pins can be mounted.

For mounting the pins at the separation distance $D_1$, adapter block 178 is oriented as shown in FIG. 4B with its socket centered on hole cluster center 197; the end of the linkage pin is then inserted into the socket and locked by turning a screw into holes 193 and 195. The bolts 315 are then turned into holes 185 to securely mount the adapter block against the housing wall. For mounting the main and linkage pins at separation distance $D_2$, the adapter block is turned over from the position shown in FIG. 4B so that socket center 187 is centered over hole cluster center 200. The end of the linkage pin is then inserted into and locked with the socket, and the adapter block is mounted to the housing wall using the fastener bolts.

A support block structure 202 (FIGS. 3 and 4B) is provided for reinforcing the adapter block when it is mounted on the housing wall. The support block structure comprises a first elongate block 204 secured as by welding in a position lengthwise of the housing wall where its upper edge abuts the lower edge of the adapter block when the latter is mounted for either separation distance $D_1$ or $D_2$. A second elongate block 206 is secured as by welding in a position transverse of the housing wall and with its side edge abutting the end edge of the adapter block when the latter is mounted. A similar support block structure, not shown, is provided at the housing wall for the opposite end of the linkage pin.

Figure 9:
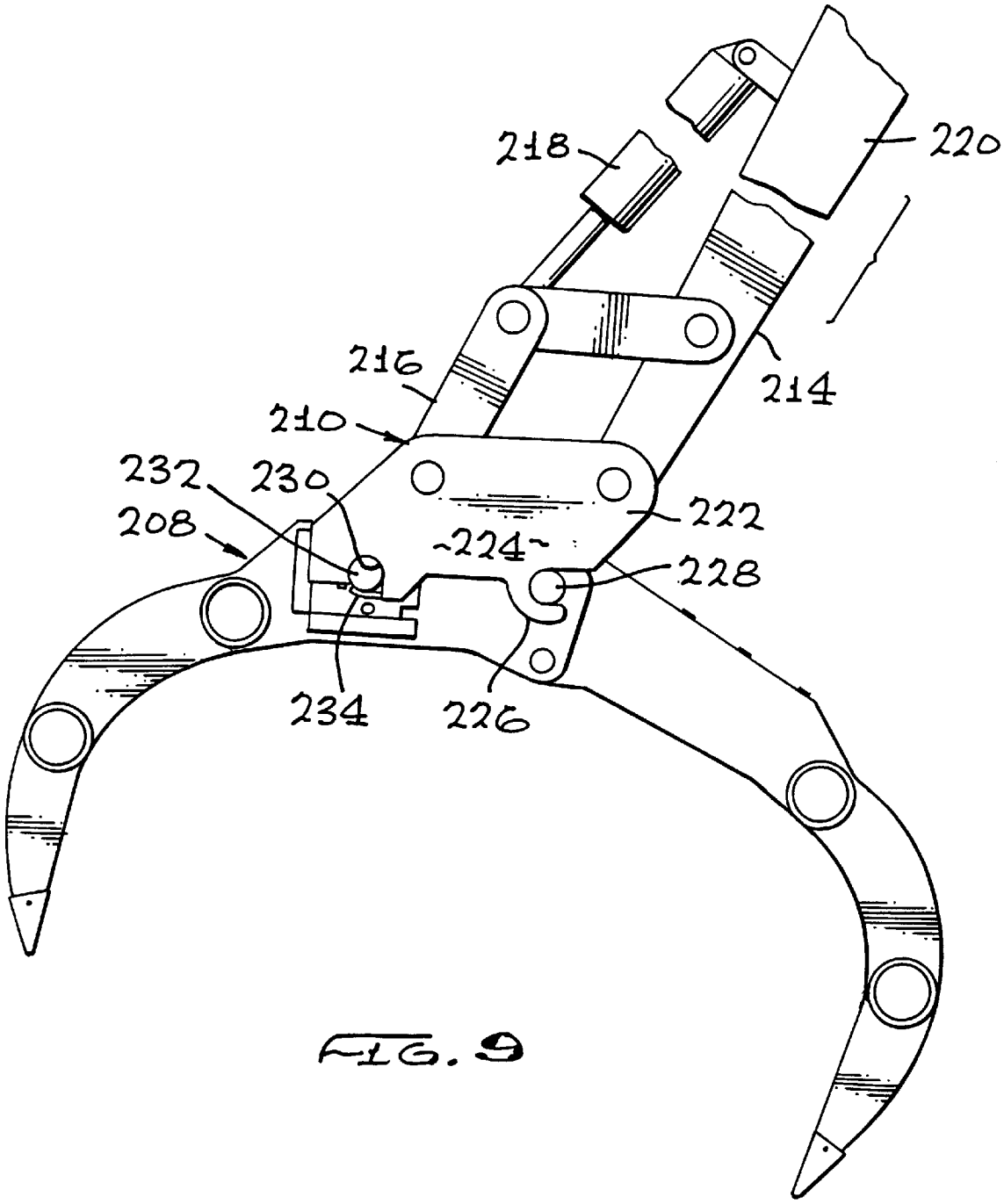
FIG. 9 is a side elevation view of grapple apparatus in accordance with another embodiment.

FIG. 9 illustrates another embodiment of the invention providing grapple apparatus 208 attached through a mounting structure comprising a quick couple device 210 that is carried at the end of a boom assembly 212. The boom assembly is comprised of a dipper stick 214 pivotally mounted at the end of the main boom, not shown, and a pitch control link 216 which is moved by an hydraulic actuator 218 that is connected to the upper end 220 of the dipper stick. The construction and operation of grapple apparatus 208 is similar to that described for the embodiment of FIGS. 1–8.

Quick coupler 210 is comprised of a coupler body 222 having opposite sides 224, one of which is shown, with each side formed with a downwardly curved hook 226 which is suitably sized for releasably seating on the shank of main pin 228. Coupler sides 224 are also formed with a downwardly facing recess 230 which is suitably sized for releasably fitting over the shank of linkage pin 232. A latch 234, which is pivotally mounted within the coupler body, is operated by a suitable hydraulic actuator, not shown, between the locked position shown in FIG. 9 capturing linkage pin 232 against recess 230, and a released position which enables the linkage pin to pull out of the recess. This enables the operator to quickly couple and decouple the grapple apparatus without the requirement of disassembling and then reassembling the main and linkage pins.

The grapple apparatus of the present invention is universal in application in that it is compatible for attachment with substantially all of the different sized double pin mounting systems in the industry. The mounting arrangement of the invention can be adjusted to accommodate double pin mounting systems of either metric or English measurements. The main and linkage pins of the grapple can be easily changed at the job site using small hand tools. The main pin and tapered lock bushings can be easily disassembled and replaced with pins and bushings of the size required for a particular application. A different sized linkage pin can also be accommodated by disassembling and replacing the adapter block and linkage pin with another adapter block and pin of the desired size. In addition, the invention allows the grapple apparatus to be used on mounting systems having different separation distances between openings for the main and linkage pins. This can be easily accomplished at the job site by disassembling the fastener bolts from the adapter block, turning the adapter block so that its socket is over the alternate hole center, and then remounting the block onto the housing wall. The grapple of the invention can either be directly attached to the openings on the machine's boom, or it can also be attached to a two pin quick coupler that may be in use on the boom.

The invention also enables the operator to have a greater degree of flexibility and more complete control over movement of the grapple. The same control lever in the operator's compartment that would be used for rotating the excavating bucket through its range of movement is used to control the forward and reverse pitch of the entire grapple apparatus through the same range of movement. The grapple jaws can be controlled by means of a push button located on the lever which controls pitch of the grapple, thereby enabling control of both pitch and jaw opening/closing movement to be controlled by one hand of the operator. Also, because the grapple jaw closing/opening is independent from the other controls for the boom position and grapple pitch, the clamping forces of the jaws are not affected when the grapple is rotated through its full motion while holding a load.

Because the mounting configuration of the invention is the same as the standard excavating bucket, the grapple of the present invention can be used for light excavation work. Also because the forces opposed by down pressure and digging are taken directly from the machine end to the mounting pins through the grapple frame to the ground, no stress is put on the clamping cylinders or bell crank. Because the actuators for the jaws are within the housings, the hydraulic lines from those actuators only need to be connected to the accessory control circuit of the machine. The closed design of the actuators also protect the hydraulic cylinders and bell crank from damage.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. Grapple apparatus for attachment to the end of a boom for use in grasping or lifting or moving objects, the grapple apparatus comprising the combination of first and second supports each of which has a proximal end and a distal end, the first and second supports being mounted together at said proximal ends to at least one free-floating force resisting element for pivotal movement about a first axis, a first actuator mechanism carried by the second support, the first actuator mechanism extending or retracting in length responsive to being actuated, said force resisting element being mounted to said first actuator mechanism about a second axis, the force resisting element having one arm portion which extends radially out from the first axis, said second axis being located at a distal end of said one arm portion, the first actuator mechanism being pivotably mounted between said distal end of said one arm portion of the force resisting element and the distal end of said second support, a second actuator mechanism carried by the first support, the force resisting element comprising an other arm portion which extends radially out from the first axis at an acute angle from said one arm portion, the second actuator mechanism being pivotably mounted about a third axis located on the distal end of the other arm portion of the force resisting element, and mounted between the third axis and the distal end of the first support, said second actuator mechanism functioning to change the location of said second axis, said first and second actuator mechanisms being connected to work in unison.

2. Grapple apparatus as in claim 1 in which the first and second supports each includes an outer wall which encloses a cavity, and the first and second actuator mechanisms being within the cavity of the first and second supports.

3. Grapple apparatus as in claim 1 in which the force resisting element comprises a bell crank.

4. Grapple apparatus as in claim 1 in which the second support has a longitudinal centerline, and the first actuator mechanism comprises a pair of actuators positioned substantially equidistant on opposite sides of the centerline with the pair of actuators extending and retracting while applying thrust forces of substantially equal magnitude to the first support.

5. Grapple apparatus as in claim 4 in which the second support includes a pair of longitudinally spaced housings, and the pair of actuators each being carried within one of the pair of spaced housings.

6. Grapple apparatus as in claim 1 in which the first actuator mechanism is actuated responsive to fluid under pressure.

7. Grapple apparatus as in claim 6 in which the first actuator mechanism comprises a cylinder having a head end and a rod end together with a rod which extends and retracts responsive to said fluid under pressure being directed respectively into the head end and the rod end.

8. Grapple apparatus as in claim 1 in which a tool is carried by the distal end of each of the first and second supports, the tool on the second support moving toward and away from the tool on the first support responsive to said pivotal movement of the second support with respect to said first support for grasping or lifting or moving said objects.

9. Grapple apparatus as in claim 1 in which the second support includes a housing, and the first actuator mechanism is carried within the housing.

10. Grapple apparatus as in claim 1 in which the first support includes a housing, and the second actuator mechanism is carried within the housing.

11. Grapple apparatus as in claim 10, additionally including an attachment mechanism mounted intermediate the pair of spaced housings and adapted for mounting the grapple apparatus to an associated boom.

12. Grapple apparatus as in claim 11 in which the attachment mechanism includes a pair of spaced shaft members removably secured to walls of the pair of longitudinally spaced housings.

13. Grapple apparatus as in claim 12, additionally including means for removably securing the pair of spaced shaft members to the walls of the pair of longitudinally spaced housings.

14. Grapple apparatus as in claim 13 in which the means includes at least one bushing mounted around ends of at least one of the spaced shaft members and a lock structure for releasably locking the bushing about the end of the shaft member.

15. Grapple apparatus as in claim 13 in which the means comprises a quick couple device.

16. The grapple apparatus of claim 1, additionally including means for moving said first support with respect to said second support about said first axis.

17. A grapple apparatus comprising:

a first support, a second support, at least one free-floating bell crank defining a first, a second, and a third axis thereon, said first support being pivotally mounted about said first axis, said second support being pivotably mounted about said first axis, means for simultaneously moving said first and second supports about a fourth axis located on an attachment mechanism, a first actuator means for pivotably moving said second support about said first axis, and a second actuator means pivotably connected to said first support and pivotably mounted about said third axis, said first and second actuator means being capable of simultaneous actuation, whereby movement of said first and second actuator means causes movement of said bell crank about said first axis and causes a change of location of said second axis such that an outer end of said second support can be pivoted away from or towards an outer end of said first support.

18. The grapple apparatus of claim 17, additionally including a housing for each of said first and second actuator means.

19. The grapple apparatus of claim 17, wherein said first and second actuator means each comprises a pair of spaced actuator mechanisms, each actuator mechanism being located with a housing.

20. The grapple apparatus of claim 19, additionally including an attachment mechanism mounted intermediate the spaced housings of the first and second actuator means, and adapted for mounting the grapple apparatus to an associated boom.

* * * * *